US009067414B2

(12) United States Patent
Sasagawa et al.

(10) Patent No.: US 9,067,414 B2
(45) Date of Patent: Jun. 30, 2015

(54) LIQUID EJECTION HEAD AND METHOD OF DRIVING THE SAME

(75) Inventors: Naoto Sasagawa, Kawasaki (JP); Koichi Kitakami, Chigasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 230 days.

(21) Appl. No.: 13/436,204

(22) Filed: Mar. 30, 2012

(65) Prior Publication Data

US 2012/0268511 A1 Oct. 25, 2012

(30) Foreign Application Priority Data

Apr. 19, 2011 (JP) ..... 2011-093013

(51) Int. Cl.

| | |
|---|---|
| ***B41J 29/38*** | (2006.01) |
| ***B41J 2/015*** | (2006.01) |
| ***B41J 2/165*** | (2006.01) |
| ***B41J 2/14*** | (2006.01) |
| ***B41J 2/045*** | (2006.01) |

(52) U.S. Cl.

CPC ..... *B41J 2/14233* (2013.01); *B41J 2/04533* (2013.01); *B41J 2/04581* (2013.01); *B41J 2/04588* (2013.01); *B41J 2/04596* (2013.01); *B41J 2202/11* (2013.01)

(58) Field of Classification Search

USPC ..... 347/10–11, 20, 27, 19

See application file for complete search history.

(56) References Cited

U.S. PATENT DOCUMENTS

| | | | | |
|---|---|---|---|---|
| 2001/0050696 | A1* | 12/2001 | Suzuki et al. | 347/27 |
| 2006/0007260 | A1* | 1/2006 | Oku | 347/19 |
| 2008/0150983 | A1* | 6/2008 | Sasaki | 347/11 |
| 2009/0278877 | A1* | 11/2009 | Kimura et al. | 347/10 |
| 2010/0215921 | A1* | 8/2010 | Kagose | 428/195.1 |
| 2011/0205273 | A1* | 8/2011 | Hibino | 347/10 |

FOREIGN PATENT DOCUMENTS

| | | | |
|---|---|---|---|
| CN | 101137508 | A | 3/2008 |
| JP | 3613297 | B2 | 1/2005 |
| JP | 2009-148927 | A | 7/2009 |

* cited by examiner

*Primary Examiner* — Jason Uhlenhake

(74) *Attorney, Agent, or Firm* — Canon USA, Inc., IP Division

(57) ABSTRACT

A liquid ejection head includes a plurality of ejection orifices, liquid chambers, piezoelectric actuators, and driving units, and a control unit. Each ejection orifice ejects liquid, each liquid chamber communicates individually with an ejection orifice, each piezoelectric actuator is disposed individually for a liquid chamber and generates energy to eject liquid, and each driving unit individually drives a piezoelectric actuator. The control unit controls each driving unit to output a first voltage pulse to eject liquid or a second voltage pulse to vibrate a meniscus of liquid in a state in which the meniscus is held in a liquid chamber. The control unit selects ejection orifices used to eject liquid and controls to output the first voltage pulse to them, and selects ejection orifices not used to eject liquid and controls to output the second voltage pulse to them to perform respective concurrent recording and recovery operations.

12 Claims, 19 Drawing Sheets

LIQUID EJECTION HEAD AND METHOD OF DRIVING THE SAME

BACKGROUND OF THE INVENTION

1. Field of the Invention

The present invention relates to a liquid ejection head configured to eject liquid using a piezoelectric actuator, and a method of driving such a liquid ejection head.

2. Description of the Related Art

In recent years, in ink-jet recording technology, to suppress deformation of paper such as curling or cockling caused by a water content of ink, a technique has been investigated to eject high-viscosity ink with a low water content. In the ink-jet recording, an increase occurs in viscosity of ink located close to an ejection orifice of a nozzle that has not been used to eject ink for a long period. The increase in viscosity of ink can cause the ejection orifice to be clogged, which can cause a reduction in ejection performance or even an ejection failure. This phenomenon tends to occur in particular when the ink used is high in viscosity and contains a large amount of colorant or the like per unit volume.

One of methods of preventing ejection orifices from being clogged is to use a meniscus vibration. In this method, a meniscus is slightly vibrated using an actuator thereby stirring ink with an increased viscosity located close to an ejection orifice. Specific techniques based on this method are disclosed in Japanese Patent No. 3613297 and Japanese Patent Laid-Open No. 2009-148927.

In the technique disclosed in Japanese Patent No. 3613297, a meniscus exposed outside an ejection orifice is vibrated by an actuator with a small amplitude at a particular frequency. On the other hand, in the technique disclosed in Japanese Patent Laid-Open No. 2009-148927, a meniscus adjuster such as an electric syringe is used to first draw a meniscus in an ejection orifice in an inward direction by depressurizing a liquid chamber communicating with the ejection orifice and then vibrate the meniscus with a small amplitude.

In the technique disclosed in Japanese Patent No. 3613297, the meniscus is vibrated in a state in which the meniscus is exposed to the outside of the ejection orifice, and thus there is a possibility that ink is incorrectly ejected or scattered. Therefore, in this technique, the vibration of the meniscus is limited to that with a small amplitude. The high-viscosity ink tends to easily increase in viscosity, and thus the small amplitude of vibration of the meniscus may not surely prevent the ejection orifice from being clogged. In the technique disclosed in Japanese Patent Laid-Open No. 2009-148927, the meniscus is vibrated such that the meniscus is first drawn to an inwardly displaced position and the vibration is performed at the displaced position, and thus it is possible to vibrate the meniscus with a large amplitude. Therefore, the technique disclosed in Japanese Patent Laid-Open No. 2009-148927 is capable of preventing the ejection orifice from being clogged with high-viscosity ink more effectively than can be by the technique disclosed in Japanese Patent No. 3613297. However, in the technique disclosed Japanese Patent Laid-Open No. 2009-148927, in addition to the piezoelectric element for ejecting ink, the meniscus adjuster is disposed in a flow path between the ink tank and the recording head. The necessity of the additional provision of the meniscus adjuster results in an increase in complexity and size of the apparatus.

SUMMARY OF THE INVENTION

According to an aspect of the present invention, a liquid ejection head includes a plurality of ejection orifices, wherein each ejection orifice is configured to eject liquid through the ejection orifice, a plurality of liquid chambers, wherein each liquid chamber is configured to communicate individually with a corresponding ejection orifice, a plurality of piezoelectric actuators, wherein each piezoelectric actuator is disposed individually for a corresponding liquid chamber and configured to generate energy to eject liquid through the corresponding ejection orifice, a plurality of driving units, wherein each driving unit is configured to individually drive a corresponding piezoelectric actuator, and a control unit configured to control the plurality of driving units so that each driving unit outputs, to a corresponding piezoelectric actuator, a first voltage pulse or a second voltage pulse, wherein the first voltage pulse drives a corresponding piezoelectric actuator to eject liquid through the corresponding ejection orifice and the second voltage pulse drives a corresponding piezoelectric actuator to vibrate a corresponding meniscus of liquid such that the meniscus vibrates in the corresponding liquid chamber in a state in which the meniscus is held in the liquid chamber, and wherein the control unit selects, from the plurality of ejection orifices, one or more ejection orifices used to eject liquid and controls driving units corresponding to the selected ejection orifices such that these driving units output the first voltage pulse to thereby perform a recording operation, and the control unit controls driving units corresponding to ejection orifices that are not used to eject liquid such that these driving units output the second voltage pulse to thereby perform a recovery operation concurrently with the recording operation.

According to another aspect of the invention, a method of driving a liquid ejection head includes preparing the liquid ejection head including a plurality of ejection orifices, wherein each ejection orifice is configured to eject liquid through the ejection orifice, a plurality of liquid chambers, wherein each liquid chamber is configured to communicate individually with a corresponding ejection orifice, and a plurality of piezoelectric actuators, wherein each piezoelectric actuator is disposed individually for a corresponding liquid chamber and configured to operate such that, in response to a first voltage pulse being applied, each piezoelectric actuator ejects liquid through the corresponding ejection orifice and, in response to a second voltage pulse being applied, each piezoelectric actuator vibrates a corresponding meniscus of liquid such that the meniscus vibrates in the corresponding liquid chamber in a state in which the meniscus is held in the liquid chamber, performing a first step including selecting, from the plurality of ejection orifices, one or more ejection orifices used to eject liquid and applying the first voltage pulse to piezoelectric actuators corresponding to the selected ejection orifices, and performing a second step concurrently with the first step, the second step including applying the second voltage pulse to piezoelectric actuators corresponding to ejection orifices that are not used to eject liquid.

Further features of the present invention will become apparent from the following description of exemplary embodiments with reference to the attached drawings.

DESCRIPTION OF THE EMBODIMENTS

First Embodiment

Figure 1:
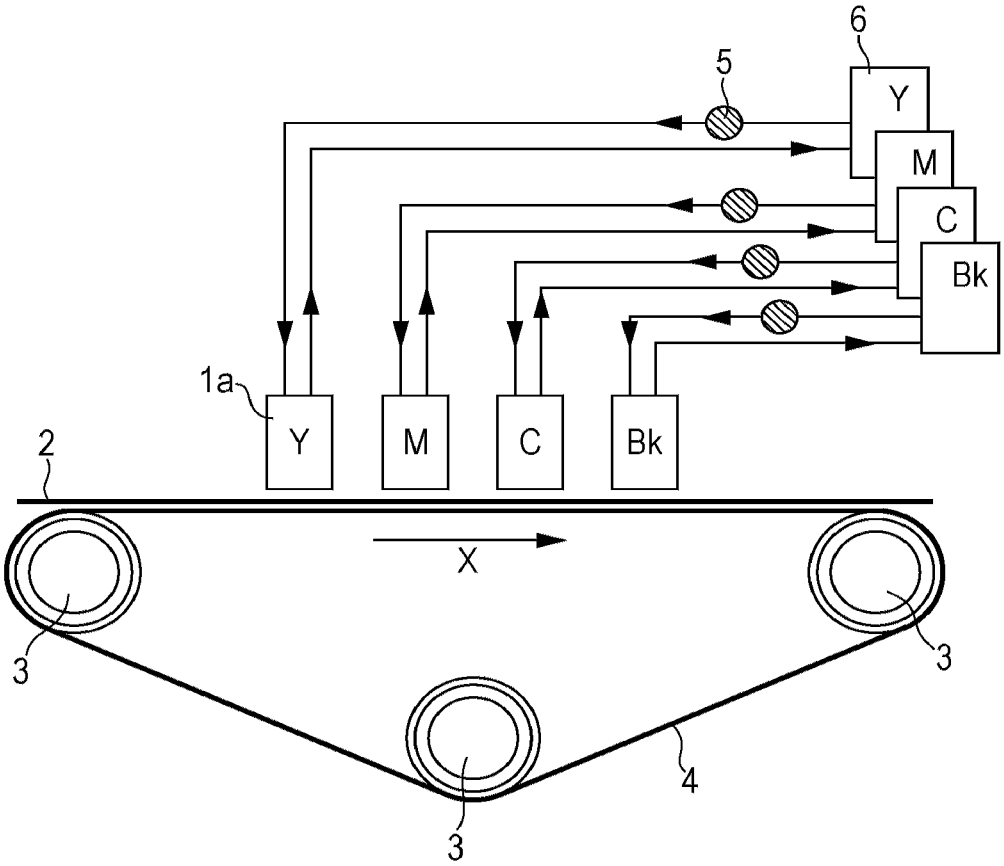
FIG. 1 is a diagram illustrating a configuration of main parts of an ink-jet recording apparatus including a liquid ejection head according to a first embodiment.

FIG. 1 illustrates a configuration of main parts of an ink-jet recording apparatus including a liquid ejection head according to a first embodiment. In the ink-jet recording apparatus shown in FIG. 1, a recording medium 2 is placed on a conveying belt 4 with an endless shape stretched between conveying rollers 3, and the conveying belt 4 is driven to convey the recording medium 2 in a conveying direction (represented by an arrow X). As shown in FIG. 1, the ink-jet recording apparatus includes four liquid ejection heads 1*a* to which ink is supplied from ink tanks 6 via pumps 5. Each liquid ejection head 1*a* is configured to handle ink of specified one of four colors including yellow (Y), magenta (M), cyan (C), and black (Bk), and liquid ejection heads 1*a* are arranged in the same direction as the conveying direction of the recording medium 2. Full-color recording is performed by ejecting color ink from the liquid ejection heads 1*a* while conveying the recording medium 2 in the conveying direction.

Figure 2A:
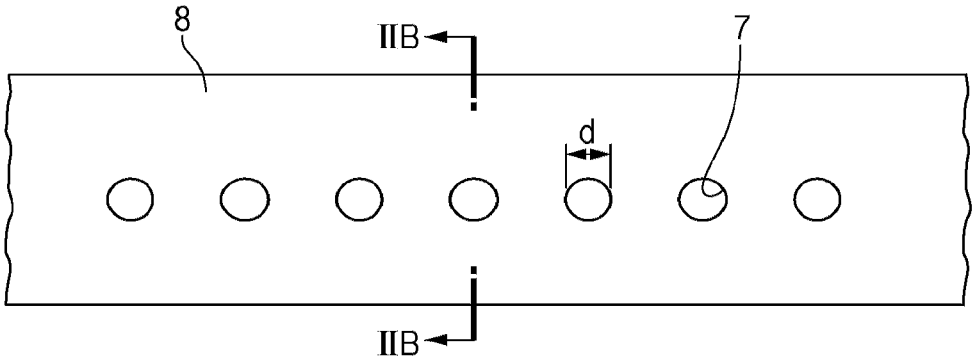
FIG. 2A and FIG. 2B are diagrams illustrating a structure of a liquid ejection head according to the first embodiment.
Figure 2B:
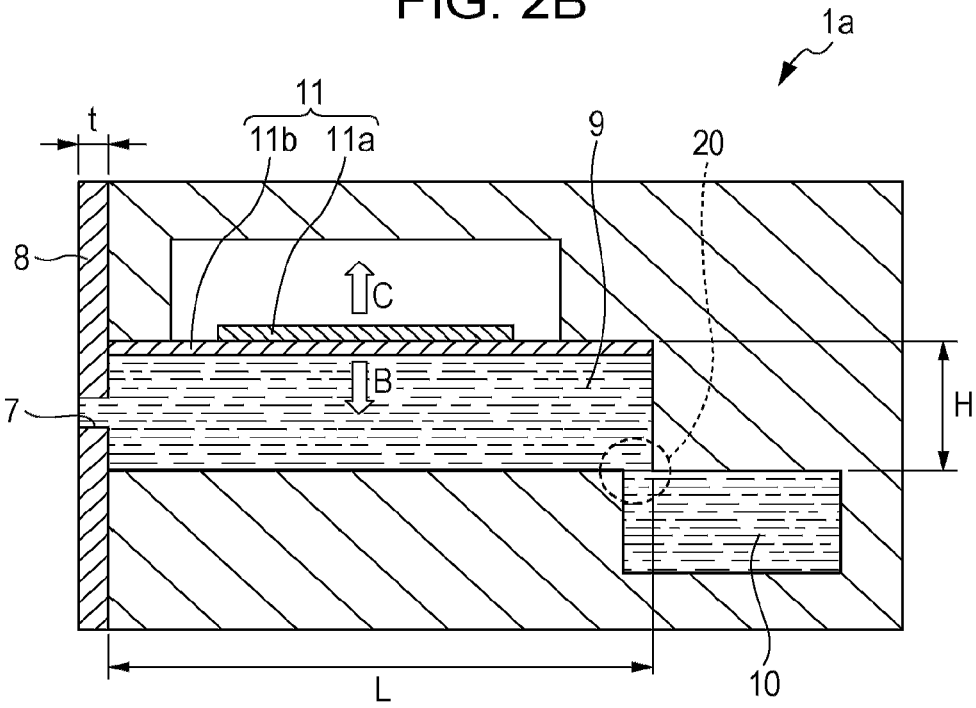
Figure 3:
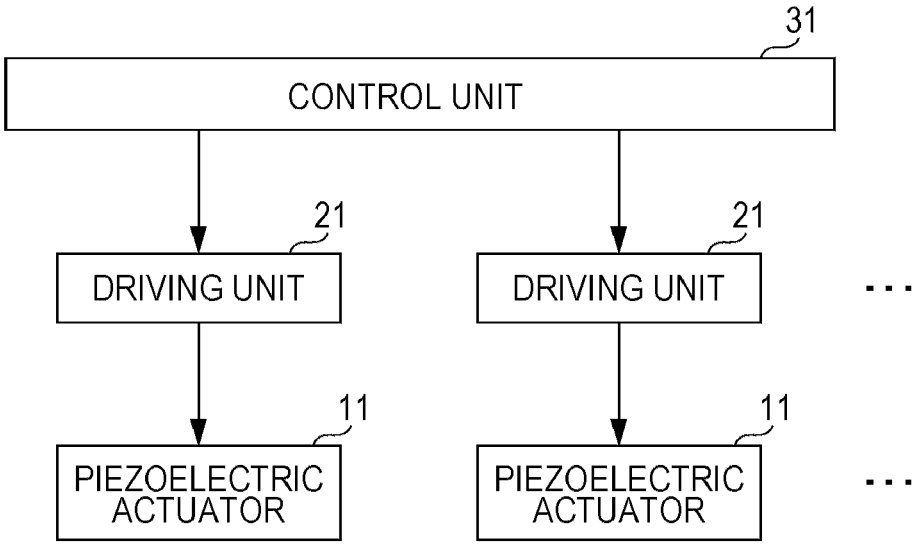
FIG. 3 is a block diagram illustrating a process of electrically controlling the liquid ejection head shown in FIG. 2A and FIG. 2B.

FIGS. 2A and 2B illustrate a structure of the liquid ejection head according to the present embodiment. FIG. 2A is a plan view of the liquid ejection head 1*a* seen from the side of the ink ejection orifices. FIG. 2B is a cross-sectional view taken along line IIB-IIB of FIG. 2A. FIG. 3 is a block diagram illustrating a process of electrically controlling the liquid ejection head shown in FIG. 2A and FIG. 2B.

In the present embodiment, as shown in FIG. 2A, each liquid ejection head 1*a* includes an ejection orifice plate 8 having a plurality of ejection orifices 7. The ejection orifices 7 are arranged depending on the width of the recording medium 2. In the present embodiment, each ejection orifice 7 is a circular orifice with a diameter (d) of 17 μm (see FIG. 2A). The ejection orifice plate 8 has a thickness (t) of 17 μm (see FIG. 2B).

Each ejection orifice 7 individually communicates with a liquid chamber 9. Each liquid chamber 9 has a length (L) of 6000 μm, a width (W) of 100 μm, and a height (H) of 200 μm (see FIG. 2B). Each liquid chamber 9 communicates with a common liquid chamber 10 via a narrowed part 20 with a width of 30 μm.

On a wall of the liquid chamber 9, there is provided a piezoelectric actuator 11 that generates energy to eject liquid (ink) through the ejection orifice 7. In the present embodiment, the piezoelectric actuator 11 includes a bend-mode piezoelectric element 11*a* and a vibrating plate 11*b* on which the piezoelectric element 11*a* is disposed. The piezoelectric element 11*a* is driven by a driving unit 21 (see FIG. 3). Under the control of a control unit 31 (see FIG. 3), the driving unit 21 outputs a voltage pulse P1 (first voltage pulse (see FIG. 4)) to the piezoelectric element 11*a* thereby to eject ink through the ejection orifice 7. On receiving the voltage pulse P1, the piezoelectric element 11*a* drives the vibrating plate 11*b* such that the vibrating plate 11*b* is first bent in a direction to the inside of the liquid chamber 9 (as indicated by an arrow B in FIG. 2B) and then returns into an initial state. This causes the liquid chamber 9 to contract, and, as a result, ink is ejected through the ejection orifice 7 and recording is performed. In the present embodiment, by way of example, clear ink (containing 66% of PEG 600, 33% of pure water, and 1% of surfactant) with a viscosity of $40\times10^{-3}$ Pa·s (at chamber temperature) and a surface tension of $38\times10^{-3}$ N/m (at chamber temperature) is used as the ink.

Figure 4:
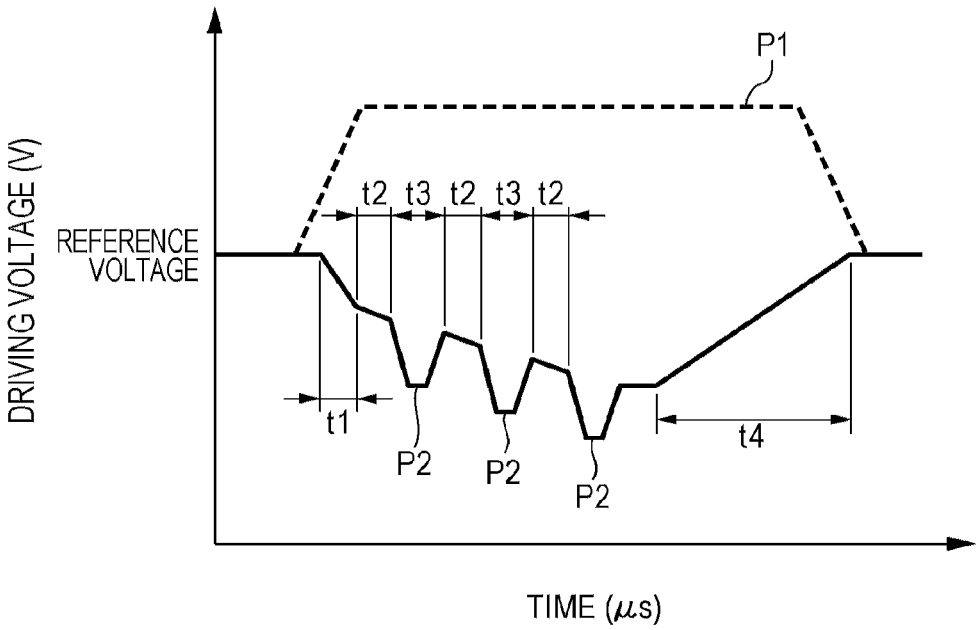
FIG. 4 is a graph illustrating waveforms of voltage pulses used to drive the liquid ejection head shown in FIG. 2A and FIG. 2B.

Next, an operation of the liquid ejection head 1*a* according to the present embodiment is described. FIG. 4 is a graph illustrating waveforms of driving voltage pulses used in the liquid ejection head 1*a* according to the present embodiment. In FIG. 4, a horizontal axis represents time, and a vertical axis represents a driving voltage supplied to the piezoelectric element 11*a* from the driving unit 21.

If a recording information representing content to be recorded is input from the main part of the ink-jet recording apparatus to the control unit 31, then the control unit 31 selects ejection orifices used to eject ink from the plurality of ejection orifices 7 based on the input recording information. The control unit 31 then controls driving units 21 corresponding to the selected ejection orifices to output the voltage pulse P1 to the corresponding piezoelectric elements 11*a* thereby to perform the recording operation.

In parallel to the recording operation described above, the control unit 31 controls driving units 21 corresponding to ejection orifices that are not used to eject ink such that the driving units 21 supply a second voltage pulse to the corresponding piezoelectric elements 11*a* thereby to perform a recovery operation in which the ink in the liquid chamber 9 is stirred. The recovery operation and the behavior of the meniscus 12 of ink during the recovery operation are described below. FIGS. 5A to 5F illustrate behavior of the meniscus 12 of ink in the liquid ejection head according to the present embodiment.

Figure 5A:
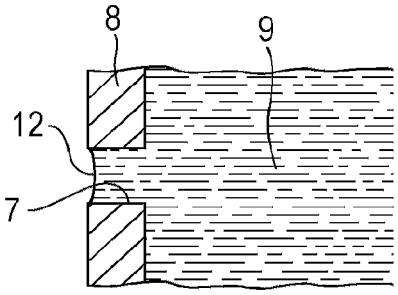
FIGS. 5A to 5F are diagrams illustrating behavior of a meniscus of ink in the liquid ejection head shown in FIG. 2A and FIG. 2B.
Figure 5D:
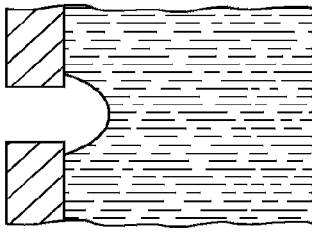
Figure 5B:
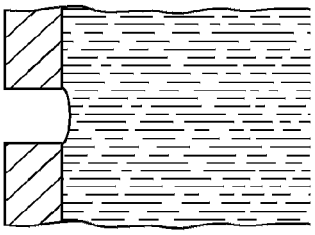
Figure 5E:
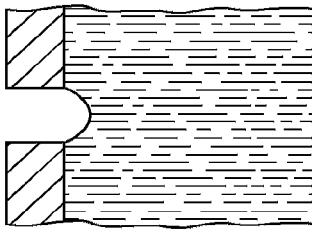

In an initial state before the recovery operation is performed, the meniscus 12 of ink is located at the outer end of the ejection orifice 7 and within the ejection orifice 7 (see FIG. 5A). In a first period t1 (see FIG. 4) in the recovery operation, under the control of the control unit 31, the driving unit 21 applies a voltage lower than a reference voltage to the piezoelectric element 11*a* such that the vibrating plate 11*b* is deformed so as to be bent in a direction to the outside of the liquid chamber 9 (as indicated by an arrow C in FIG. 2B), thereby expanding the liquid chamber 9. The expansion of the liquid chamber 9 causes the meniscus 12 to be drawn from the ejection orifice 7 into the inside of the liquid chamber 9 (see FIG. 5B).

Figure 5C:
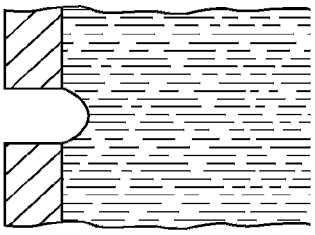
Figure 5F:
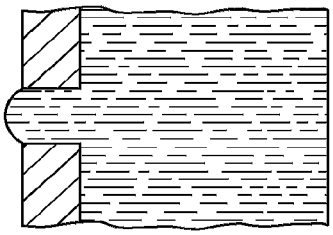

In a period t2 (see FIG. 4), to prevent the meniscus 12 from returning back to the ejection orifice 7, the driving unit 21 applies, to the piezoelectric element 11*a*, a voltage lower than the voltage applied during the period t1 (see FIG. 4) such that the liquid chamber 9 continues to gradually expand and the meniscus 12 remains within the liquid chamber 9 (see FIG. 5C).

In a period t3 (see FIG. 4), the driving unit 21 supplies a voltage pulse P2 to the piezoelectric element 11*a* a plurality of times successively (see FIG. 4). Each time the voltage pulse P2 is applied to the piezoelectric element 11*a*, the vibrating plate 11*b* moves in a direction to the outside of the liquid chamber 9 (as represented by an arrow C in FIG. 2B) and returns back to its original position (i.e., the vibrating plate 11*b* vibrates). In response to the outward/backward movement of the vibrating plate 11*b*, the meniscus 12 vibrates (see FIG. 5C to FIG. 5E).

In a period t4 (see FIG. 4), the liquid chamber 9 is contracted such that the liquid chamber 9 returns into its original state and the meniscus 12 returns into its initial state. The meniscus 12 goes to the outside of the ejection orifice 7 beyond its original position (see FIG. 5F) and then returns to its original position (shown in FIG. 5A). In the present embodiment, as described above, the ejection for recording and the operation for recovery are performed using a simple mechanism including the piezoelectric actuator 11. Use of the actuator 11 instead of a pump or the like to vibrate the meniscus makes it possible to achieve quick response in vibrating the meniscus because the actuator 11 is located close to the ejection orifice where the meniscus is formed.

Furthermore, in the present embodiment, the recovery operation in which the voltage pulse P2 is output by the driving units 21 corresponding to the ejection orifices 7 that are not used to eject ink is performed concurrently with the recording operation in which the voltage pulse P1 is output by the driving units 21 corresponding to the ejection orifices 7 that are used to eject ink. Therefore, during the recording operation, it is possible to stir the ink in liquid chambers 9 communicating with the ejection orifices 7 that are not used to eject ink, which makes it possible to ejection orifices 7 from being clogged even if there is a nozzle that is not used for a long period. Furthermore, it is possible to vibrate the meniscus 12 while keeping the location of the meniscus 12 in the liquid chamber 9, and thus it is possible to effectively recover the ejection orifices 7 from the clogged state by greatly vibrating the meniscus 12 without causing liquid to be ejected. Therefore, even when the ink used has a high viscosity, it is possible to prevent the ejection orifice 7 from being clogged.

Furthermore, in the present embodiment, the piezoelectric actuator 11 has two functions, i.e., the function of ejecting ink and the function of stirring ink in the liquid chamber 9 (thereby vibrating the meniscus 12). Therefore, an additional special part is not necessary to prevent the ejection orifice 7 from being clogged with ink, and thus high cost performance can be achieved.

Figure 6:
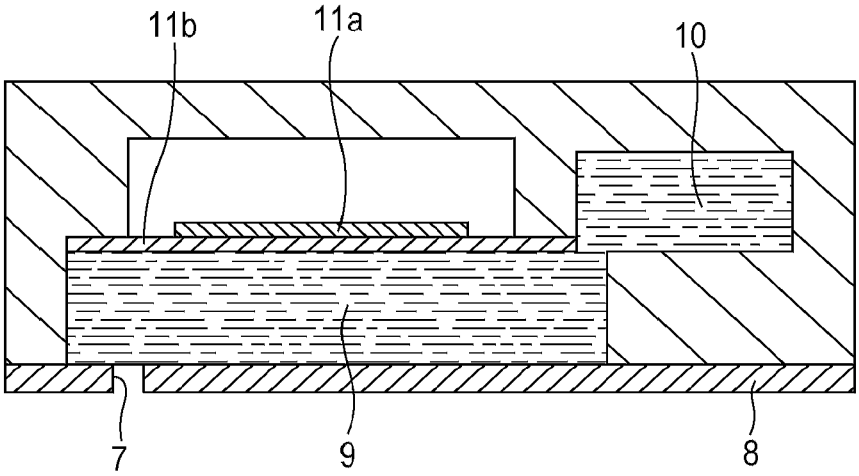
FIG. 6 is a cross-sectional view illustrating another structure of a liquid ejection head according to an embodiment.

In the present embodiment, the liquid ejection head 1*a* is of an edge shooter type in which the ejection orifice 7 is formed in a direction in which the liquid chamber 9 extends (i.e., in a direction in which ink flows) as shown in FIG. 2B. Alternatively, the liquid ejection head 1*a* may be of a side shooter type in which the ejection orifice 7 is formed in a direction perpendicular to the direction in which the liquid chamber 9 extends as shown in FIG. 6.

In the present embodiment, the bend-mode piezoelectric element is used as the piezoelectric element 11*a*. Alternatively, other types such as a push-mode type, a share-mode type, or a Gould type may be used as the piezoelectric element 11*a*.

Second Embodiment

Figure 7:
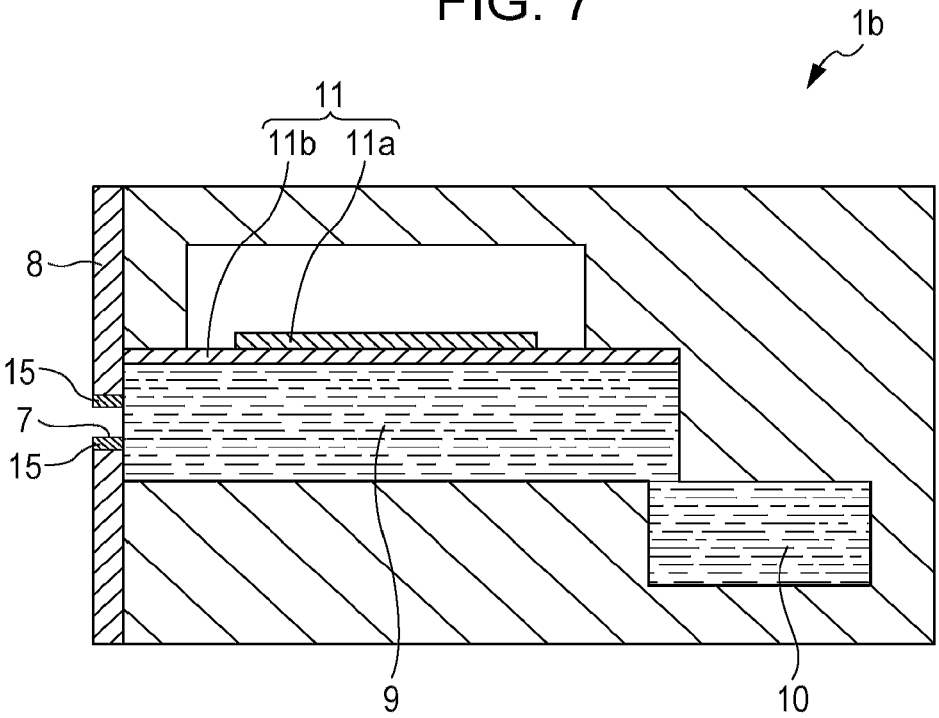
FIG. 7 is a cross-sectional view illustrating a structure of a liquid ejection head according to a second embodiment.

FIG. 7 is a cross-sectional view illustrating a structure of a liquid ejection head 1*b* according to a second embodiment. In FIG. 7, similar elements to those of the liquid ejection head 1*a* according to the first embodiment are denoted by similar reference numerals and a further detailed description thereof is omitted.

In the liquid ejection head 1*b* according to the present embodiment, as shown in FIG. 7, a liquid-repellent layer 15 that is repellent to ink is formed on an inner wall of an ejection orifice 7.

Figure 8:
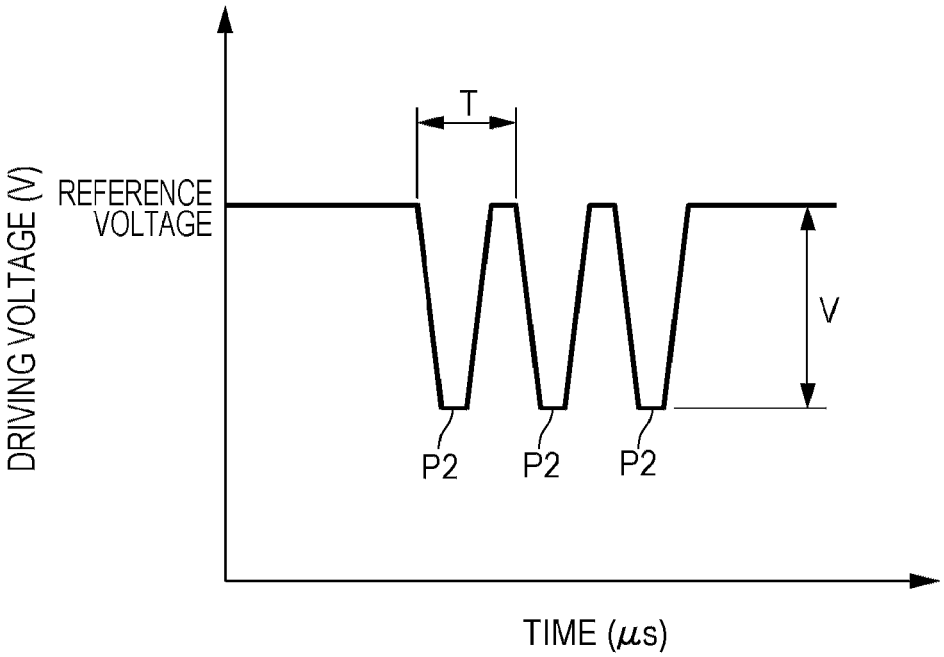
FIG. 8 is a graph illustrating a waveform of a voltage pulse used to drive the liquid ejection head shown in FIG. 7.

Also in the present embodiment as in the first embodiment, a recovery operation is performed. The recovery operation of the liquid ejection head 1*a* according to the present embodiment and the behavior of the meniscus 12 of ink during the recovery operation are described below. FIG. 8 is a graph illustrating a waveform of a voltage pulse used to drive the liquid ejection head 1*b* according to the present embodiment. In FIG. 8, a horizontal axis represents time, and a vertical axis represents a driving voltage supplied to a piezoelectric element 11*a* from a driving unit 21. FIGS. 9A to 9F illustrate behavior of the meniscus 12 of ink in the liquid ejection head 1*b* according to the present embodiment.

Figure 9A:
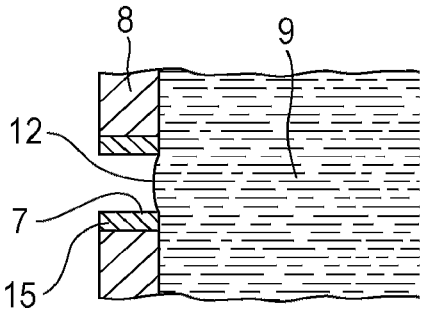
FIGS. 9A to 9F are diagrams illustrating behavior of a meniscus of ink in the liquid ejection head shown in FIG. 7.
Figure 9D:
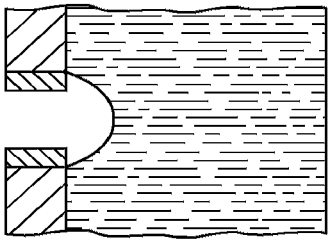
Figure 9B:
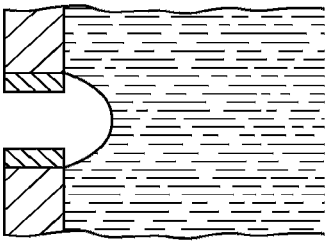
Figure 9E:
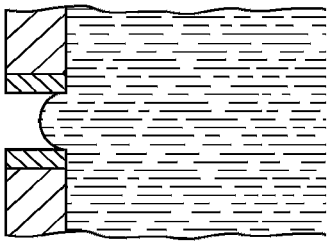
Figure 9C:
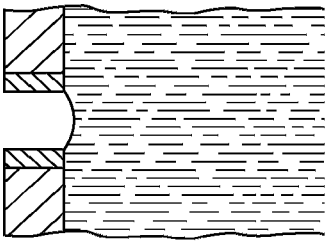

In an initial state before the recovery operation is performed, the provision of the liquid-repellent layer 15 formed on the inner wall of the ejection orifice 7 ensures that the meniscus 12 is kept at an inner opening end, at the boundary with the liquid chamber, of the ejection orifice 7 (see FIG. 9A). First, the driving unit 21 outputs a trapezoidal-waveform voltage pulse P2 to the piezoelectric element 11*a*. In response to the voltage pulse P2 applied to the piezoelectric element 11*a*, the vibrating plate 11*b* vibrates in a direction to the outside of the liquid chamber 9. This causes the meniscus 12 is first drawn into the liquid chamber 9 and then returns to its original position (see FIG. 9B and FIG. 9C). When a next voltage pulse P2 is applied, the meniscus 12 is again drawn into the liquid chamber 9 (see FIG. 9D). In the present embodiment, the vibration is performed repeatedly three times. The vibration of the meniscus 12 enhances diffusion of colorants or a surfactant and destroys a film of a colorant or a surfactant.

Figure 9F:
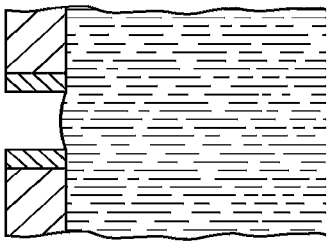

When the third-time application of the voltage pulse P2 is ended, the meniscus 12 is moved from the common liquid chamber 10 to the ejection orifice 7 by a flow of ink (see FIG. 9E) and the meniscus 12 finally returns into the initial state shown in FIG. 9F.

In the present embodiment, the voltage pulse P2 with a repetition period (T) of 2 μs (see FIG. 8) and an amplitude (V)

of 15 volts (see FIG. 8) is applied to the piezoelectric element 11*a* thereby to vibrate the meniscus 12 with an amplitude of about 14 μm, which can recover the ejection orifice 7 of the nozzle from the clogged state caused by the increase in viscosity of ink.

The voltage pulse P2 used in the present embodiment has a repetition period (T) of 2 μs which corresponds to a frequency of 50 kHz. The higher the frequency of the vibration of the meniscus 12, the more effectively the nozzle can be recovered. From this point of view, the frequency of the voltage pulse P2 may be set to be several tens kHz or higher.

In the present embodiment, the provision of the liquid-repellent layer 15 formed on the inner wall of the ejection orifice 7 prevents the meniscus 12 from being incorrectly ejected from the ejection orifice 7 or scattered even when the meniscus 12 is vibrated greatly in the recovery operation.

Third Embodiment

A liquid ejection head according to a third embodiment is described below. The liquid ejection head according to the present embodiment has a similar structure to that of the liquid ejection head 1*b* according to the second embodiment. The details of the liquid ejection head 1*b* according to the third embodiment are described below while focusing on differences from that according to the second embodiment.

Figure 10:
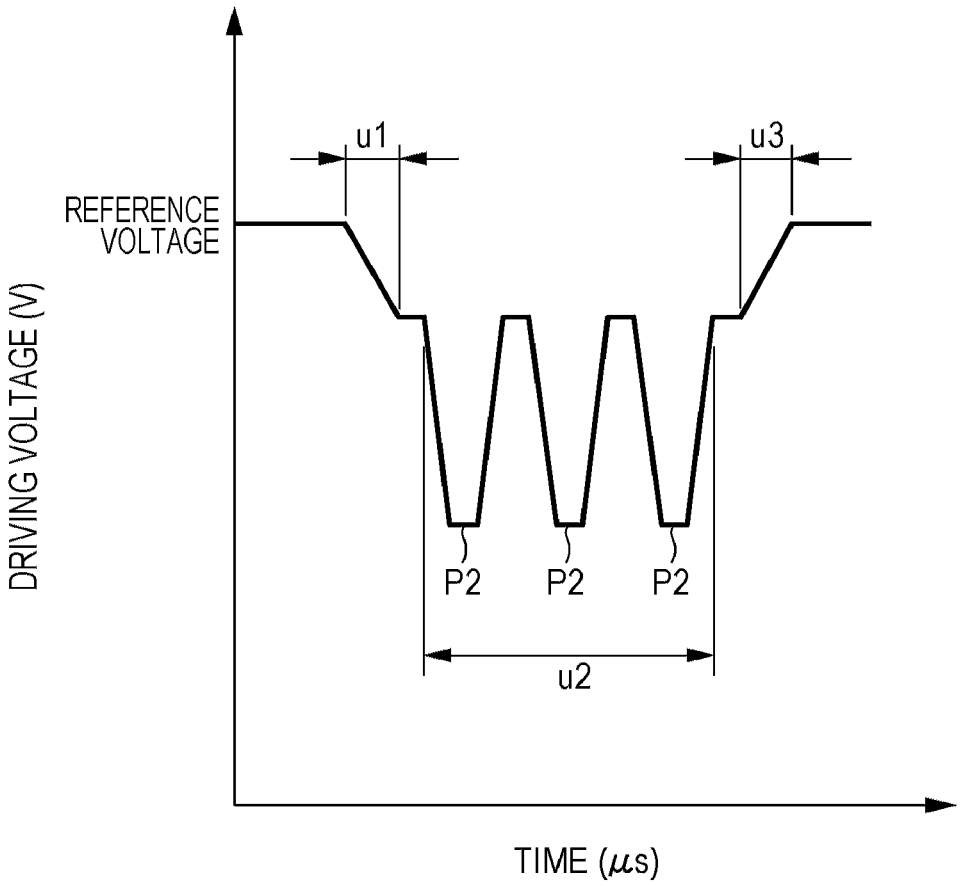
FIG. 10 is a graph illustrating a driving voltage pulse waveform used to drive a liquid ejection head according to a third embodiment.

FIG. 10 is a graph illustrating a waveform of a driving voltage pulse used in the liquid ejection head 1*b* according to the present embodiment. In FIG. 10, a horizontal axis represents time, and a vertical axis represents a driving voltage supplied to the piezoelectric element 11*a* from the driving unit 21. FIGS. 11A to 11F illustrate behavior of a meniscus of ink in the liquid ejection head 1*b* according to the present embodiment.

In an initial state before a recovery operation is started, presence of a liquid-repellent layer 15 formed on an inner wall of an ejection orifice 7 causes the meniscus 12 to be held at an inner opening end, at the boundary with the liquid chamber 9, of the ejection orifice 7 (see FIG. 11A) as in the second embodiment.

In a period u1 (see FIG. 10) in the recovery operation, the driving unit 21 applies a voltage lower than a reference voltage to the piezoelectric element 11*a* whereby the liquid chamber 9 is expanded. As a result, the meniscus 12 is drawn further into the inside of the liquid chamber 9 (see FIG. 11B).

Figure 11A:
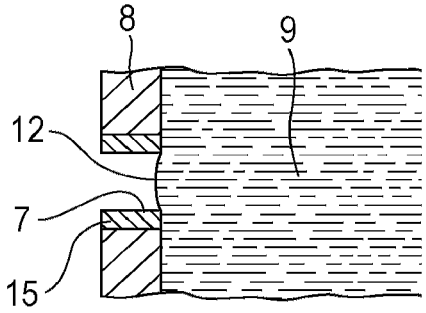
FIGS. 11A to 11F are diagrams illustrating behavior of a meniscus of ink in a liquid ejection head according to the third embodiment.
Figure 11D:
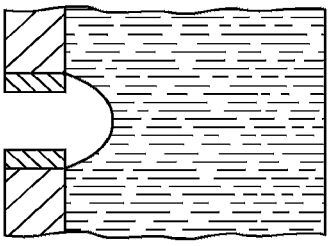
Figure 11B:
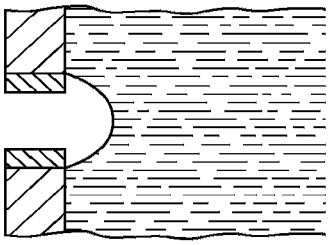
Figure 11E:
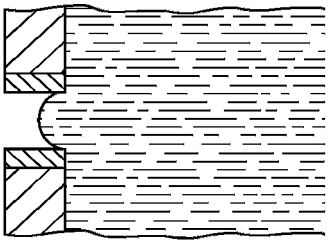
Figure 11C:
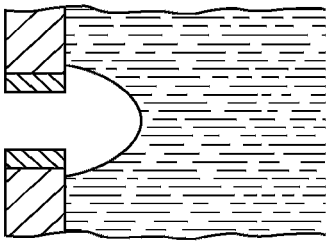
Figure 11F:
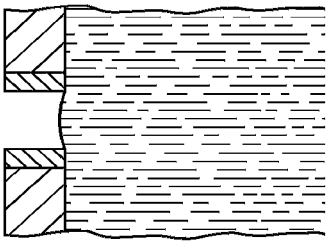

In a period u2 (see FIG. 10) following the period u1, the driving unit 21 supplies a voltage pulse P2 to the piezoelectric element 11*a* three times successively thereby to vibrate the meniscus 12 (see FIG. 11B to FIG. 11D).

In a period u3 (see FIG. 10) following the period u2, the liquid chamber 9 is contracted such that the liquid chamber 9 returns into its original state and the meniscus 12 returns into its initial state. The meniscus 12 is moved from the common liquid chamber 10 to the ejection orifice 7 by a flow of ink (see FIG. 11E) and the meniscus 12 finally returns into its initial state (see FIG. 11F).

In the present embodiment, the meniscus 12 is first drawn from an inner opening end, at the boundary with the liquid chamber 9, of the ejection orifice 7 to the position displaced to the inside of the liquid chamber 9, and then the meniscus 12 is vibrated at the displaced position. This further reduces the probability that ink is incorrectly ejected or scattered, and thus it becomes possible to vibrate the meniscus 12 with a large amplitude. The large-amplitude vibration makes it possible to more effectively recover the ejection orifice 7 of the nozzle from the clogged state caused by the increase in viscosity of ink.

Fourth Embodiment

Figure 12:
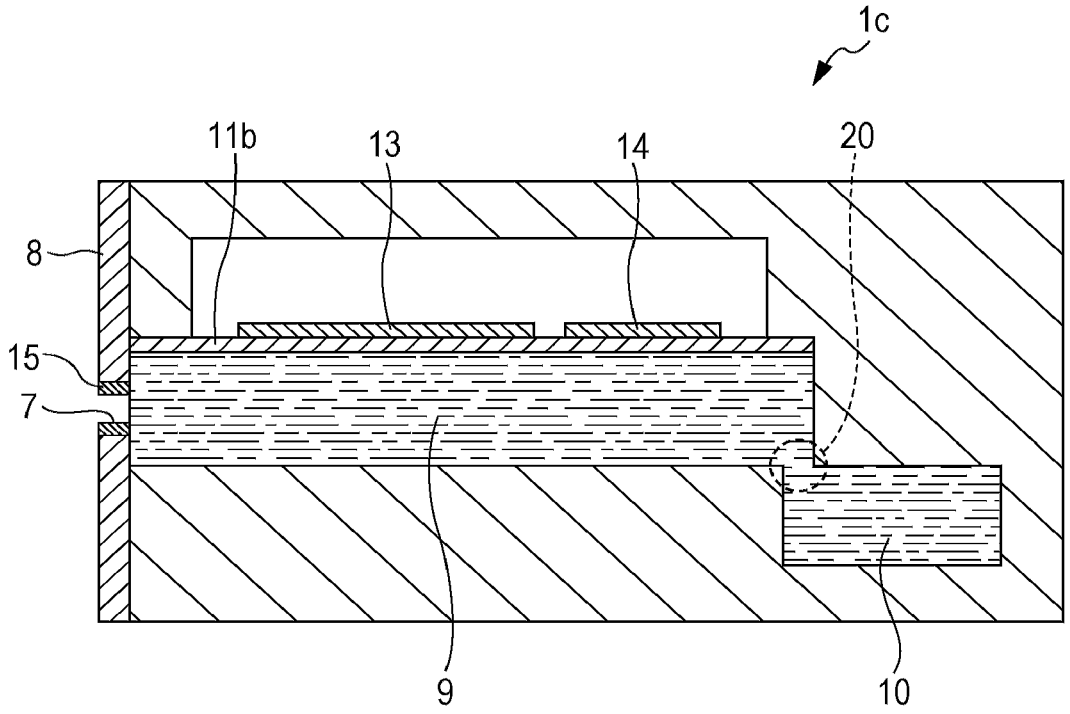
FIG. 12 is a cross-sectional view illustrating a structure of a liquid ejection head according to a fourth embodiment.

FIG. 12 is a cross-sectional view illustrating a structure of a liquid ejection head according to a fourth embodiment. In FIG. 12, similar elements to those of the liquid ejection head according to the previous embodiment are denoted by similar reference numerals and a further detailed description thereof is omitted.

The liquid ejection head 1*c* according to the present embodiment includes a first piezoelectric element 13 and a second piezoelectric element 14 disposed on the vibrating plate 11*b* such that the second piezoelectric element 14 is located farther away from the ejection orifice 7 than the first piezoelectric element 13 is located. In the present embodiment, the first piezoelectric element 13 and the second piezoelectric element 14 are both bend-mode piezoelectric elements as with the piezoelectric element 11*a* described above. The first piezoelectric element 13 and the second piezoelectric element 14 are driven by separate driving units 21. A liquid-repellent layer 15 is formed on an inner wall of the ejection orifice 7. The each liquid chamber 9 has a length of 9000 μm, while the width and the height thereof are equal to those according to the previous embodiments. Each liquid chamber 9 communicates with a common liquid chamber 10 via a narrowed part 20 with a width of 50 μm.

Figure 13:
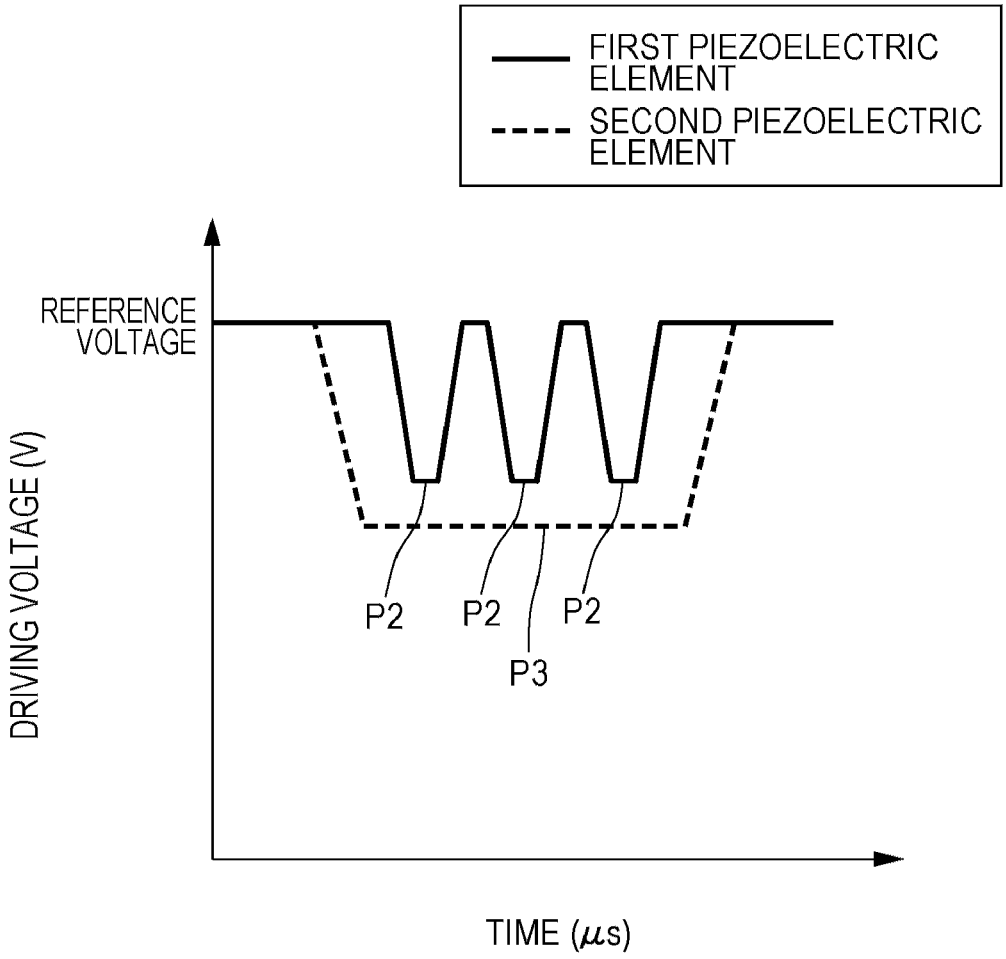
FIG. 13 is a graph illustrating waveforms of voltage pulses used to drive the liquid ejection head shown in FIG. 12.

Also in the present embodiment as in the previous embodiments, a recovery operation is performed concurrently with a recording operation. The recovery operation of the liquid ejection head according to the present embodiment and the behavior of the meniscus of ink during the recovery operation are described below. FIG. 13 is a graph illustrating a driving voltage pulse waveform used to drive the liquid ejection head 1*c* according to the present embodiment. In FIG. 13, a horizontal axis represents time, and a vertical axis represents driving voltages supplied to a first piezoelectric element 13 and second piezoelectric element 14. FIGS. 14A to 14F illustrate behavior of a meniscus of ink in the liquid ejection head 1*c* according to the present embodiment.

Figure 14A:
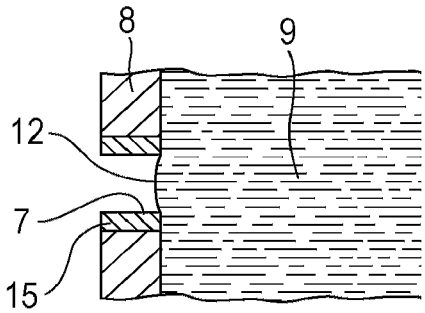
FIGS. 14A to 14F are diagrams illustrating behavior of a meniscus of ink in the liquid ejection head shown in FIG. 12.
Figure 14D:
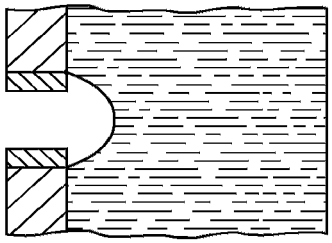
Figure 14B:
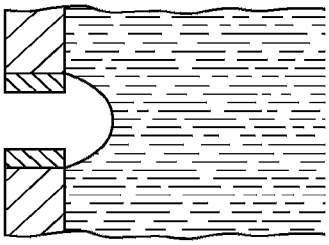
Figure 14E:
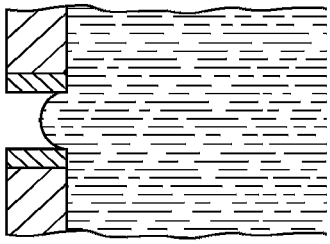
Figure 14C:
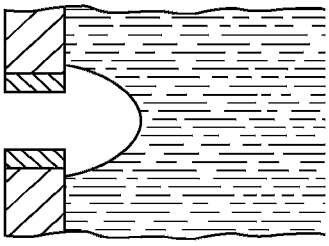
Figure 14F:
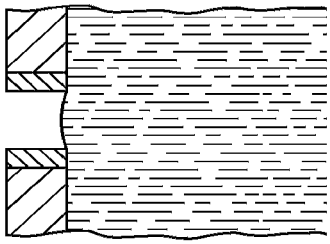

In an initial state before the recovery operation is performed, the provision of the liquid-repellent layer 15 formed on the inner wall of the ejection orifice 7 ensures that the meniscus 12 is kept at the inner opening end, at the boundary with the liquid chamber 9, of the ejection orifice 7 (see FIG. 14A). First, one driving unit 21 outputs a voltage pulse P3 (third voltage pulse) to the second piezoelectric element 14. In response, the liquid chamber 9 starts to expand and the meniscus 12 is drawn further into the inside of the liquid chamber 9 (see FIG. 14B). Thereafter, the other driving unit 21 outputs a voltage pulse P2 to the first piezoelectric element 13. In response, the meniscus 12 vibrates (see FIG. 14B to FIG. 14D). When the applying of the voltage pulse P3 with a pulse width greater than that of the second voltage pulse is ended, the liquid chamber 9 contracts into its original state and the meniscus 12 returns into its initial state. In this process, the meniscus 12 is moved from the common liquid chamber 10 to the ejection orifice 7 by a flow of ink (see FIG. 14E) and the meniscus 12 finally returns into the initial state (see FIG. 14F).

In the present embodiment, when the voltage pulse P2 with a period of 5 μs and an amplitude of 35 volts is applied to the first piezoelectric element 13, the meniscus 12 vibrates with an amplitude of about 25 μm, which can recover the ejection orifice 7 of the nozzle from the clogged state caused by the increase in viscosity of ink.

In the present embodiment, the operation of drawing the meniscus 12 and the operation of vibrating the meniscus 12 are performed using different piezoelectric elements. This makes it possible to reduce the voltage pulse to a lower level than is allowed in the previous embodiments in which the same actuator is used to perform both operations. This allows a reduction in load on the piezoelectric elements, which results in an increase in operation life. Furthermore, it is possible to reduce the size of each piezoelectric element. The reduction in size results in an increase in natural frequency of the piezoelectric element, which makes it possible to apply a greater vibration to the ink in the liquid chamber 9.

In the present embodiment, bend-mode piezoelectric elements are used as the first piezoelectric element 13 and the second piezoelectric element 14. Alternatively, other types of piezoelectric elements such as a push-mode type, a share-mode type, a Gould type, etc., may be used.

Figure 15:
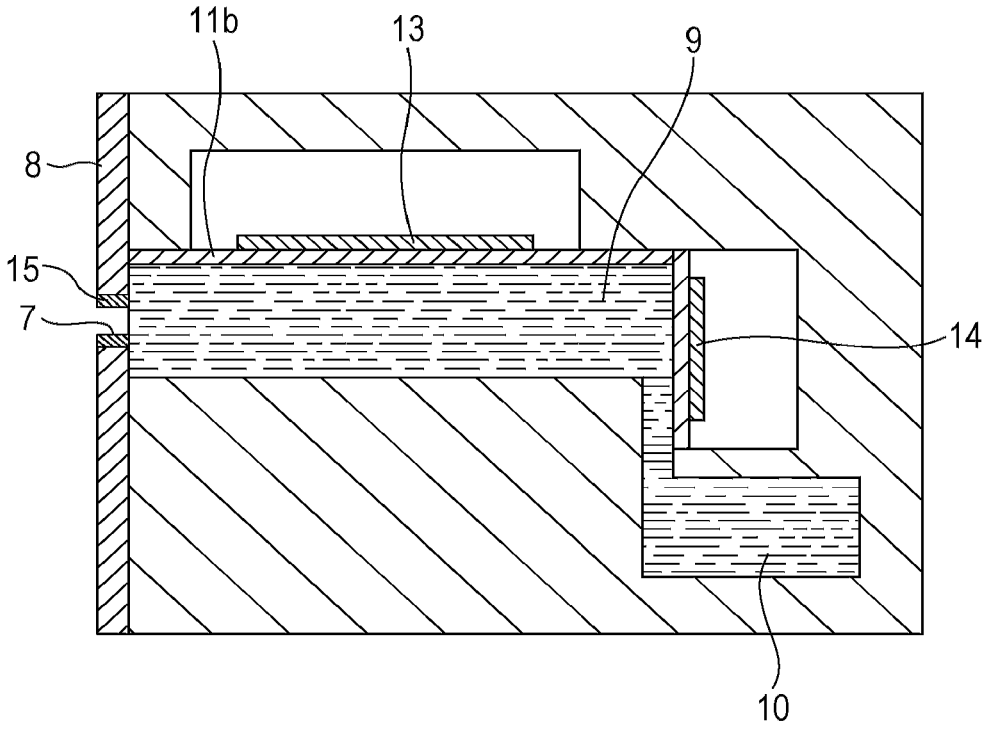
FIG. 15 is a cross-sectional view illustrating a liquid ejection head having a structure modified from that shown in FIG. 12.

In the present embodiment, the first piezoelectric element 13 and the second piezoelectric element 14 are disposed in a line. Alternatively, they may be disposed in planes perpendicular to each other as shown in FIG. 15.

Fifth Embodiment

A liquid ejection head according to a fifth embodiment is described below. The liquid ejection head according to the present embodiment has a similar structure to that of the liquid ejection head 1*c* according to the fourth embodiment (see FIG. 12). In the following description, similar elements to those of the liquid ejection head according to the previous embodiment are denoted by similar reference numerals and a further detailed description thereof is omitted.

The present embodiment provides a mechanism that is based on a simple method and that can prevent a residual vibration from occurring in a nozzle used to eject ink and can prevent clogging due to an increase in viscosity of ink from occurring in an ejection orifice 7 in a nozzle that is not used to eject ink.

Figure 16A:
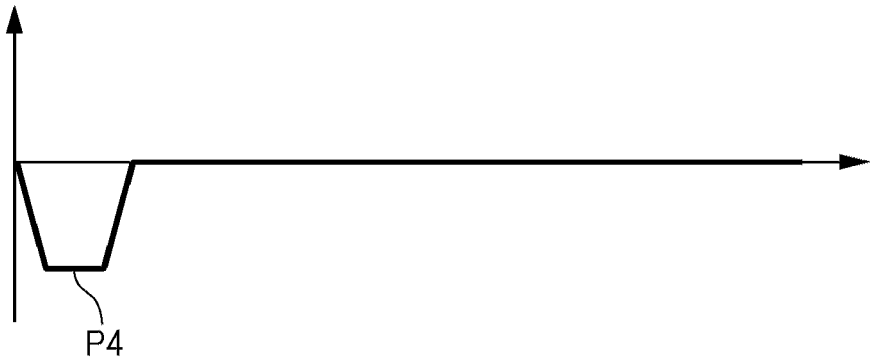
FIGS. 16A and 16B are graphs illustrating waveforms of voltage pulses applied to a nozzle used to eject ink in a liquid ejection head according to a fifth embodiment.
Figure 16B:
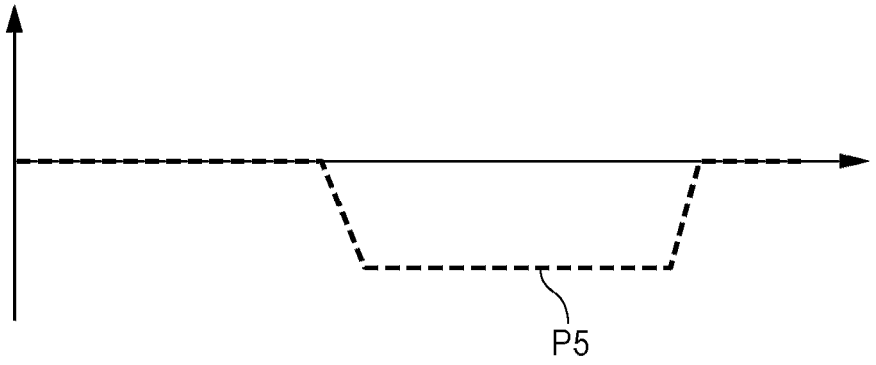
Figure 17A:
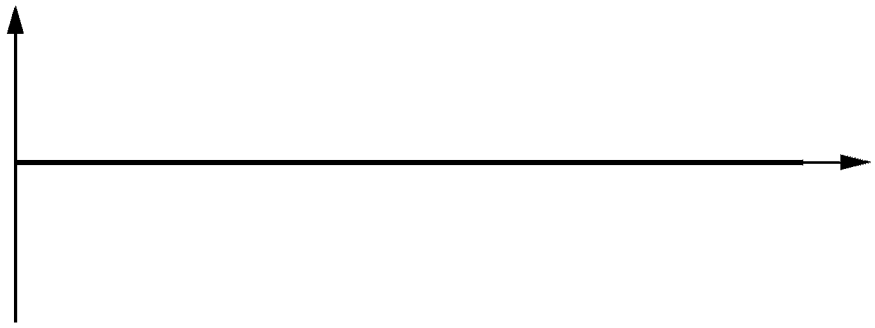
FIGS. 17A and 17B are graphs illustrating waveforms of voltage pulses applied to a nozzle that is not used to eject ink in the liquid ejection head according to the fifth embodiment.
Figure 17B:
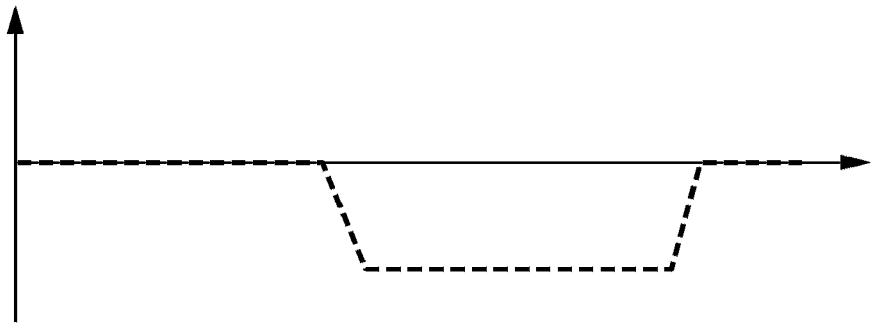
Figure 18A:
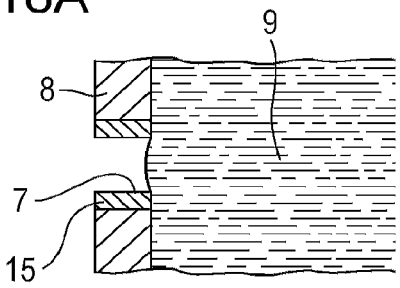
FIGS. 18A to 18H are diagrams illustrating behavior of an ink meniscus in a nozzle that is used to eject ink in the liquid ejection head according to the fifth embodiment.
Figure 18E:
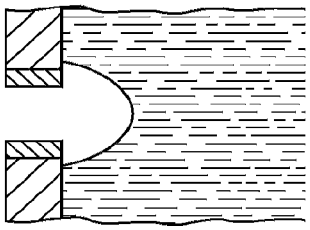
Figure 18B:
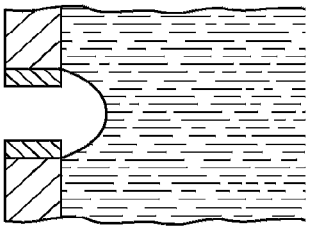
Figure 18F:
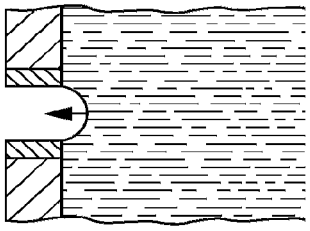
Figure 18C:
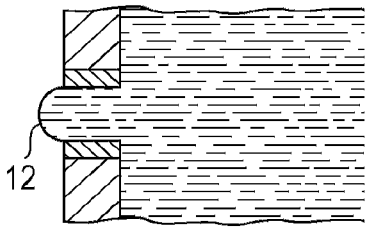
Figure 18G:
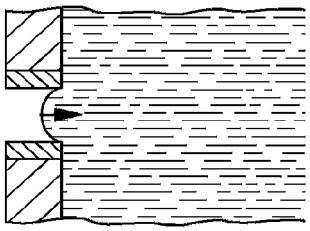
Figure 18D:
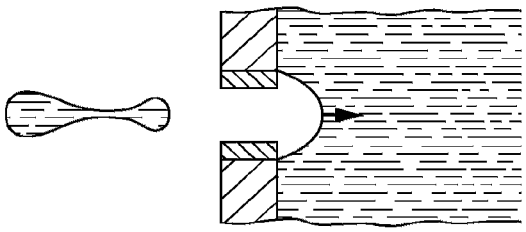
Figure 18H:
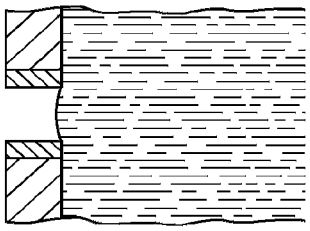
Figure 19A:
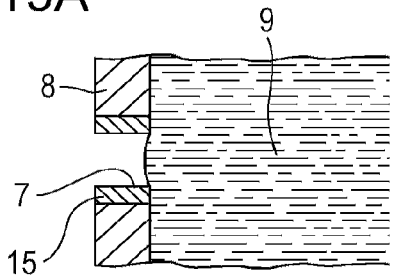
FIGS. 19A to 19H are diagrams illustrating behavior of a meniscus that would occur if a voltage pulse were not applied to a second piezoelectric element in the liquid ejection head according to the fifth embodiment.
Figure 19E:
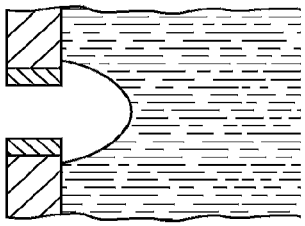
Figure 19B:
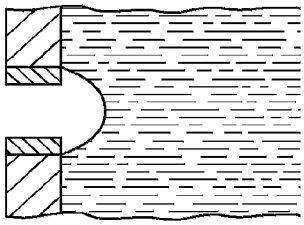
Figure 19F:
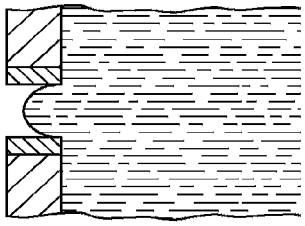
Figure 19C:
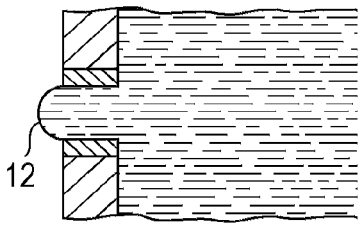
Figure 19G:
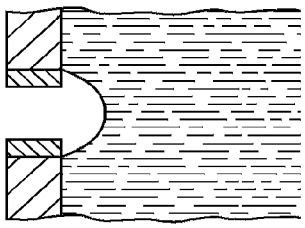
Figure 19D:
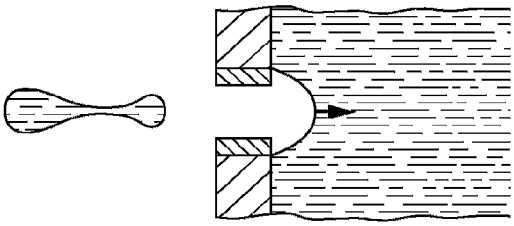
Figure 19H:
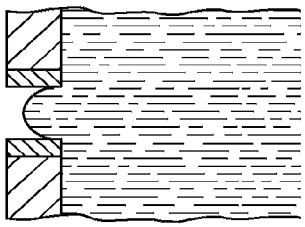

Also in the present embodiment as in the previous embodiments, a recovery operation is performed in parallel to a recording operation. Referring to FIGS. 18A to 18H and FIGS. 19A to 19H, the recovery operation of the liquid ejection head according to the present embodiment and the behavior of the meniscus 12 of ink during the recovery operation are described below. FIG. 16A is a graph illustrating a waveform of a driving voltage pulse applied to a first piezoelectric element 13 of a nozzle used to eject ink in a recording operation using a liquid ejection head 1*c* according to the present embodiment. FIG. 16B is a graph illustrating a waveform of a driving voltage pulse applied to a second piezoelectric element 14 of the nozzle used to eject ink in the recording operation. FIG. 17A is a graph illustrating a waveform of a driving voltage pulse applied to a first piezoelectric element 13 of a nozzle that is not used to eject ink. FIG. 17B is a graph illustrating a waveform of a driving voltage pulse applied to a second piezoelectric element 14 of the nozzle that is not used to eject ink. In each of FIGS. 16A and 16B and FIGS. 17A and 17B, a horizontal axis represents time, and a vertical axis represents driving voltages supplied to the first piezoelectric element 13 and the second piezoelectric element 14. FIGS. 18A to 18H illustrate behavior of the meniscus 12 of ink in a nozzle used to eject ink in the operation using the liquid ejection head 1*c* according to the present embodiment. FIGS. 19A to 19H illustrate behavior of the meniscus 12 of ink which would occur if the driving voltage pulse with the waveform shown in FIG. 16B were not applied to the second piezoelectric element 14 of the nozzle used to eject ink. FIGS. 20A to 20F are diagrams illustrating behavior of the meniscus 12 of ink in a nozzle that is included in the liquid ejection head 1*c* but that is not used to eject ink, according to the present embodiment.

Referring to FIGS. 16A and 16B and FIGS. 18A to 18H, the behavior of the meniscus 12 of ink in the nozzle used to eject ink is described below. In these figures, broken lines represent the behavior of the meniscus 12 when the voltage pulse P5 (fifth voltage pulse) is not input.

First, to eject ink, the driving unit 21 shown in FIG. 3 outputs a voltage pulse P4 (fourth voltage pulse) used to drive the first piezoelectric element 13 shown in FIG. 12 to eject ink (see FIG. 16A). In response, the ink is ejected from the ejection orifice 7 (see FIG. 18D).

Thereafter, after the meniscus 12 has returned to the original position in the ejection orifice 7, the driving unit 21 shown in FIG. 3 starts outputting a voltage pulse P5 to the second piezoelectric element 14 (see FIG. 16B). Note that the voltage pulse P5 is applied such that the expanding of the liquid chamber 9 is started when the meniscus 12 is at the returned position in the ejection orifice 7 (see FIG. 18F) and the contracting of the liquid chamber 9 is started when the meniscus 12 starts going backward by the residual vibration (see FIG. 18G). That is, the voltage pulse P5 is applied such that the liquid chamber 9 is expanded or contracted against the motion of the meniscus 12 thereby to suppress the residual vibration of the meniscus 12.

If the voltage pulse P5 is not applied to the second piezoelectric element 14 in the above-described manner, a great meniscus vibration does not easily stop after the ink ejection is complete, and thus a great reduction in the driving frequency is necessary (see FIG. 19D to FIG. 19H).

Next, referring to FIGS. 17A and 17B and FIGS. 20A to 20F, a description is given below as to the behavior of the meniscus 12 of ink in a nozzle that does not eject ink.

Figure 20A:
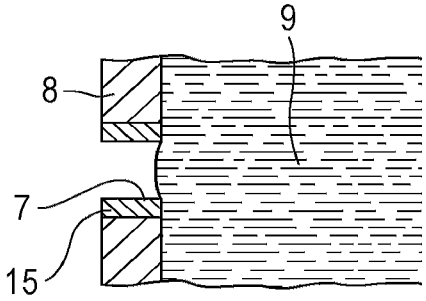
FIGS. 20A to 20F are diagrams illustrating behavior of an ink meniscus in a nozzle that is not used to eject ink in the liquid ejection head according to the fifth embodiment.
Figure 20D:
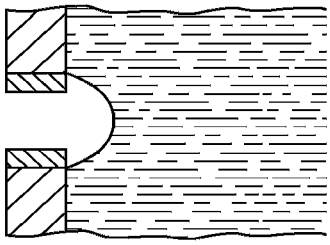
Figure 20B:
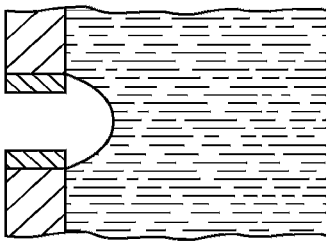
Figure 20E:
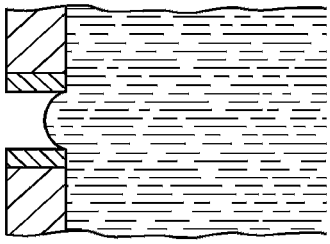
Figure 20C:
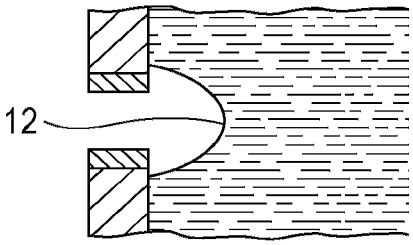
Figure 20F:
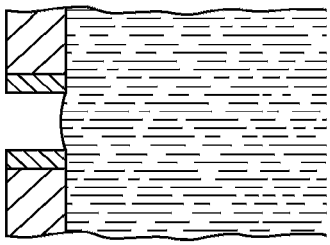

In an initial state before the recovery operation is performed, the provision of the liquid-repellent layer 15 formed on the inner wall of the ejection orifice 7 ensures that the meniscus 12 is kept at an inner opening end, at the boundary with the liquid chamber 9, of the ejection orifice 7 (see FIG. 20A). Because ink is not ejected, no driving voltage is applied to the first piezoelectric element 11*a* (see FIG. 17A). The driving unit 21 shown in FIG. 3 outputs the voltage pulse P5 to the second piezoelectric element 14 synchronously with the applying of the voltage pulse P5 to the nozzle that is used to eject ink. In response, the meniscus 12 vibrates (see FIG. 20B to FIG. 20D).

In the present embodiment, as described above, the same voltage pulse is applied to the second piezoelectric element 14 of the nozzles regardless of the nozzles are used to eject ink whereby the ejection orifices 7 are prevented from being clogged with ink due to an increase in viscosity that occurs when nozzles are not used while suppressing the residual vibration that occurs in nozzles used to eject ink. In the present embodiment, the voltage pulse applied to the second piezoelectric element 14 is equal for all nozzles regardless of whether the nozzles are used to eject ink, and thus it is not necessary to switch the voltage pulse depending on the nozzles, and thus a control process is very simple.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-093013 filed Apr. 19, 2011, which is hereby incorporated by reference herein in its entirety.

What is claimed is:

1. A liquid ejection head comprising:

a plurality of ejection orifices, wherein each ejection orifice is configured to eject liquid through the ejection orifice;

a plurality of liquid chambers, wherein each liquid chamber is configured to communicate liquid individually with a corresponding ejection orifice;

a plurality of piezoelectric actuators, wherein a piezoelectric actuator is disposed individually for a corresponding liquid chamber and configured to generate energy to eject liquid through the corresponding ejection orifice;

a plurality of driving units, wherein a driving unit is configured to individually drive a corresponding piezoelectric actuator; and a control unit configured to control the plurality of driving units so that a driving unit outputs, to a corresponding piezoelectric actuator, a first voltage pulse or a second voltage pulse, wherein the first voltage pulse drives a corresponding piezoelectric actuator to eject liquid through the corresponding ejection orifice and the second voltage pulse drives a corresponding piezoelectric actuator to vibrate a corresponding meniscus of liquid such that the meniscus vibrates within the corresponding liquid chamber in a state in which the meniscus is held within the liquid chamber and causes the meniscus to protrude out of the ejection orifice without ejecting liquid after the vibrating of the meniscus has stopped, wherein the control unit selects, from the plurality of ejection orifices, one or more ejection orifices used to eject liquid and controls driving units corresponding to the selected ejection orifices such that these driving units output the first voltage pulse to thereby perform a recording operation, and, concurrently, the control unit controls driving units corresponding to ejection orifices that are not used to eject liquid such that these driving units output the second voltage pulse to thereby perform a recovery operation concurrently with the recording operation.

2. The liquid ejection head according to claim 1, wherein a liquid-repellent layer is formed on an inner wall of each ejection orifice.

3. The liquid ejection head according to claim 1, wherein each piezoelectric actuator includes a first piezoelectric actuator, for generating energy to eject liquid through a corresponding ejection orifice, and a second piezoelectric actuator, wherein the second piezoelectric actuator is disposed such that a distance of the second piezoelectric actuator from the corresponding ejection orifice is greater than a distance of the first piezoelectric actuator from the ejection orifice, wherein the control unit controls driving units assigned to drive the first piezoelectric actuators to eject liquid and perform the recording operation, and the control unit controls driving units assigned to drive the second piezoelectric actuators to output, to the second piezoelectric actuators, a third voltage pulse having a pulse width that is greater than a pulse width of the second voltage pulse such that corresponding meniscuses are held within the liquid chambers corresponding to the second piezoelectric actuators due to expansion of the liquid chambers corresponding to the second piezoelectric actuators caused by voltage pulse.

4. The liquid ejection head according to claim 1, wherein the second voltage pulse drives a corresponding piezoelectric actuator to vibrate a corresponding meniscus of liquid such that the meniscus vibrates only within the corresponding liquid chamber and not within a corresponding ejection orifice.

5. The liquid ejection head according to claim 1, wherein a piezoelectric actuator is disposed individually for a corresponding liquid chamber outside the liquid chamber and outside of a flow path of the liquid.

6. A method of driving a liquid ejection head, wherein the liquid ejection head includes a plurality of ejection orifices, wherein each ejection orifice is configured to eject liquid through the ejection orifice, a plurality of liquid chambers, wherein each liquid chamber is configured to communicate liquid individually with a corresponding ejection orifice, a plurality of piezoelectric actuators, wherein a piezoelectric actuator is disposed individually for a corresponding liquid chamber and configured to generate energy to eject liquid through the corresponding ejection orifice, and a plurality of driving units, wherein a driving unit is configured to individually drive a corresponding piezoelectric actuator, the method comprising:

controlling the plurality of driving units so that a driving unit outputs, to a corresponding piezoelectric actuator, a first voltage pulse or a second voltage pulse, wherein the first voltage pulse drives a corresponding piezoelectric actuator to eject liquid through the corresponding ejection orifice and the second voltage pulse drives a corresponding piezoelectric actuator to vibrate a corresponding meniscus of liquid such that the meniscus vibrates within the corresponding liquid chamber in a state in which the meniscus is held within the liquid chamber and causes the meniscus to protrude out of the ejection orifice without ejecting liquid after the vibrating of the meniscus has stopped;

selecting, from the plurality of ejection orifices, one or more ejection orifices used to eject liquid; and controlling driving units corresponding to the selected ejection orifices such that these driving units output the first voltage pulse to thereby perform a recording operation by ejecting liquid, and, concurrently, controlling driving units corresponding to ejection orifices that are not used to eject liquid such that these driving units output the second voltage pulse to thereby perform a recovery operation concurrently with the recording operation.

7. The method according to claim 6, wherein controlling driving units to output the second voltage pulse includes applying a voltage pulse to the piezoelectric actuators to draw the corresponding meniscuses into the corresponding liquid chambers, and then applying a voltage pulse to the piezoelectric actuators after the corresponding meniscuses have been drawn into the corresponding liquid chambers to vibrate the meniscuses within the liquid chambers.

8. The method according to claim 6, wherein each piezoelectric actuator includes a first piezoelectric actuator, for generating energy to eject liquid through a corresponding ejection orifice, and a second piezoelectric actuator, wherein the second piezoelectric actuator is disposed such that a distance of the second piezoelectric actuator from the corresponding ejection orifice is greater than a distance of the first piezoelectric actuator from the ejection orifice, wherein controlling driving units corresponding to the selected ejection orifices includes controlling driving units assigned to drive the first piezoelectric actuators to eject liquid and perform the recording operation, and wherein controlling driving units corresponding to ejection orifices that are not used to eject liquid includes controlling driving units assigned to drive the second piezoelectric actuators to output, to the second piezoelectric actuators, a third voltage pulse having a pulse width that is greater than a pulse width of the second voltage pulse such that corresponding meniscuses are held within the liquid chambers corresponding to the second piezoelectric actuators due to expansion of the liquid chambers corresponding to the second piezoelectric actuators caused by voltage pulse.

9. A liquid ejection head comprising:

a plurality of ejection orifices, wherein each ejection orifice is configured to eject liquid through the ejection orifice;

a plurality of liquid chambers, wherein each liquid chamber is configured to communicate liquid individually with a corresponding ejection orifice;

a plurality of first piezoelectric actuators, wherein each first piezoelectric actuator is disposed individually for a corresponding liquid chamber and configured to generate energy to eject liquid through the corresponding ejection orifice;

a plurality of second piezoelectric actuators, wherein each second piezoelectric actuator is disposed such that a distance of each second piezoelectric actuator from a corresponding ejection orifice is greater than a distance of a corresponding first piezoelectric actuator from the corresponding ejection orifice;

a plurality of first driving units, wherein each first driving unit is configured to individually drive a corresponding first piezoelectric actuator;

a second driving unit configured to simultaneously drive all second piezoelectric actuators; and a control unit configured to control the first driving units and the second driving unit, wherein a liquid-repellent layer is formed on an inner wall of each ejection orifice, wherein the control unit selects, from the plurality of ejection orifices, one or more ejection orifices used to eject liquid and controls the first driving units corresponding to the selected ejection orifices such that the first driving units output the first voltage pulse to eject liquid from the selected ejection orifice to thereby perform a recording operation, and the control unit controls the second driving unit to output the second voltage pulse to the second piezoelectric actuators such that a meniscus of liquid in each ejection orifice other than the selected ejection orifices is vibrated in a state in which the meniscus is held within the corresponding liquid chamber and causes the meniscus to protrude out of the ejection orifice without ejecting liquid after the vibrating of the meniscus has stopped to thereby perform a recovery operation.

10. The liquid ejection head according to claim 9, wherein the second voltage pulse is set such that expanding of the liquid chamber is started in response to the meniscus of liquid of the selected ejection orifice starting moving toward the ejection orifice, and contracting of the liquid chamber is started in response to the meniscus of liquid of the selected ejection orifice starting moving away from the ejection orifice.

11. A liquid ejection head comprising:

ejection orifices, wherein each ejection orifice is configured to eject liquid through the ejection orifice;

liquid chambers, wherein each liquid chamber is configured to communicate liquid individually with a corresponding ejection orifice; and piezoelectric actuators, wherein each piezoelectric actuator is disposed individually for a corresponding liquid chamber and configured to generate energy to eject liquid through the corresponding ejection orifice, wherein each piezoelectric actuator is first driven to expand a volume of a corresponding liquid chamber to thereby displace a meniscus of liquid from the ejection orifice into the liquid chamber, and thereafter the piezoelectric actuator is driven to vibrate the meniscus in a state in which the meniscus is held within the liquid chamber and causes the meniscus to protrude out of the ejection orifice without ejecting liquid after the vibrating of the meniscus has stopped.

12. A method of driving a liquid ejection head: that includes ejection orifices, wherein each ejection orifice is configured to eject liquid through the ejection orifice, liquid chambers, wherein each liquid chamber is configured to communicate liquid individually with a corresponding ejection orifice, and piezoelectric actuators, wherein each piezoelectric actuator is disposed individually for a corresponding liquid chamber and configured to generate energy to eject liquid through the corresponding ejection orifice, the method comprising:

first driving each piezoelectric actuator to expand a volume of a corresponding liquid chamber to thereby displace a meniscus of liquid from the ejection orifice into the liquid chamber; and thereafter driving the piezoelectric actuator to vibrate the meniscus in a state in which the meniscus is held within the liquid chamber and causes the meniscus to protrude out of the ejection orifice without ejecting liquid after the vibrating of the meniscus has stopped.

* * * * *